US009077130B2

(12) United States Patent
Hashimoto et al.

(10) Patent No.: US 9,077,130 B2
(45) Date of Patent: Jul. 7, 2015

(54) SWITCH-EQUIPPED COAXIAL CONNECTOR

(71) Applicant: DAI-ICHI SEIKO CO., LTD., Kyoto-shi (JP)

(72) Inventors: Yoichi Hashimoto, Kanagawa (JP); Takao Yamauchi, Tokyo (JP); Yuma Watanabe, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 361 days.

(21) Appl. No.: 13/646,831

(22) Filed: Oct. 8, 2012

(65) Prior Publication Data

US 2013/0102173 A1 Apr. 25, 2013

(30) Foreign Application Priority Data

Oct. 21, 2011 (JP) ..... 2011-231222

(51) Int. Cl.

| | |
|---|---|
| ***H01R 13/70*** | (2006.01) |
| ***H01R 24/46*** | (2011.01) |
| ***H01R 13/703*** | (2006.01) |
| ***H01R 24/50*** | (2011.01) |

(52) U.S. Cl.

CPC ..... *H01R 24/46* (2013.01); *H01R 13/70* (2013.01); *H01R 13/7033* (2013.01); *H01R 24/50* (2013.01); *H01R 2201/20* (2013.01)

(58) Field of Classification Search

CPC ..... H01R 13/70; H01H 9/20; H01H 9/22; H01H 33/46; H01H 1/58; H01H 13/70; H01H 25/14; H01H 3/00; H01H 3/12; H01H 13/14; H01H 1/00; H01H 2001/00; H01H 2207/00; H01H 2207/022; H01H 2207/036; H01H 2223/00; H01H 2300/042

USPC ..... 200/51.01, 50.02, 50.28, 50.29, 51 R, 200/43.02, 329, 341, 237

See application file for complete search history.

(56) References Cited

FOREIGN PATENT DOCUMENTS

| | | |
|---|---|---|
| EP | 2 256 874 A1 | 12/2010 |
| JP | 9-245907 | 9/1997 |
| JP | 11-3637 | 1/1999 |
| JP | 11-265761 | 9/1999 |
| JP | 2002-359039 | 12/2002 |
| JP | 2006-32307 | 2/2006 |
| JP | 2011-134475 | 7/2011 |
| TW | M316555 U | 8/2007 |
| WO | WO 2010/008884 | 1/2010 |

*Primary Examiner* — Edwin A. Leon
*Assistant Examiner* — Anthony R. Jimenez
(74) *Attorney, Agent, or Firm* — Oblon, McClelland, Maier & Neustadt, L.L.P.

(57) ABSTRACT

With a simple configuration, increase in size can be avoided, usage durability is improved, and occurrence of insufficient electrical connection caused by dust can be prevented well. A crank part is provided in at least one of both contacts including elastic beam-like members. Both of the contacts are provided with cut-away parts, which substantially increase the span lengths of the elastic beam-like members, and gaps between the contacts and an insulating housing which ensure flexibility of the elastic beam-like members to ensure flexibility and prevent permanent deformation of the contacts while enhancing elasticity of the contacts. Dust which has entered the interior thereof is moved along the crank part to ensure electrical conductivity well, which is an employed configuration.

5 Claims, 14 Drawing Sheets

SWITCH-EQUIPPED COAXIAL CONNECTOR

BACKGROUND OF THE INVENTION

1. Field of the Invention

The present invention relates to a switch-equipped coaxial connector provided with a pair of contacts caused to be in a mutually-separated state when an opposing connector is mated.

2. Description of Related Art

Generally, a switch-equipped coaxial connector is used in an electronic device or an electric device such as a mobile phone. Such a switch-equipped coaxial connector is used as, for example, a small circuit test switch for testing the state or performance of various electronic circuits such as high-frequency circuits provided in the device. Each of circuit test switches disclosed in below-described Japanese Patent Application Laid-Open No. H09-245907, Japanese Patent Application Laid-Open No. 2002-359039, etc. is composed of a switch-equipped coaxial connector mounted on a circuit board so as to disconnect an electronic circuit of a main body of the device and is configured so that a probe (test needle) of a test plug connector serving as an opposing connector is inserted from the upper side toward the interior thereof through an opposing insertion hole provided in the switch-equipped coaxial connector.

In such a switch-equipped coaxial connector, an electrically-conductive shell for ground connection is attached to the outer side of an insulating housing, and a plurality of board connecting parts integrally projected from the electrically-conductive shell are configured to be joined by soldering with electrically-conductive paths on an illustration-omitted wiring board so as to be mounted thereon and subjected to use. A contact pair composed of a movable contact and a fixed contact for signal transmission is attached to the interior of the insulating housing of this case, and the movable contact and the fixed contact of the pair are respectively connected to a first side and a second side of an electronic circuit (illustration omitted) provided on the main body of the device.

A distal end of the probe (test needle) of the test plug connector, which has been inserted from the upper side, is brought into contact with the switch-equipped coaxial connector with a pressure so as to push and open a free-end part of the movable contact, which swings in an approximately horizontal plane, and, as a result, the movable contact swings and is separated from the fixed contact to disconnect the original electronic circuit. At the same time, the movable contact is brought into contact with a lower-end part of the probe; and, as a result, the probe becomes a state that the probe is conducted to another electronic circuit of the main body of the device so that, for example, an arbitrary test can be executed by outputting electric signals from the electronic circuit to the outside through the probe.

However, such a conventional switch-equipped coaxial connector has a problem in usage durability since the contacts may be permanently deformed due to, for example, repeated insertion of the probe (test needle) of the test plug connector. A means that enhances elasticity by increasing the span of the contacts is conceivable in order to improve the usage durability. However, if the lengths of the contacts are simply increased, the size of the whole connector is increased, which goes against recent demands for downsizing and reduction in height. Also, there is a problem that minute debris or dust such as insulating matters present in a usage atmosphere may enter the interior through the insertion hole of the probe (test needle) of the test plug connector and cause insufficient electrical connection.

SUMMARY OF THE INVENTION

Therefore, it is an object of the present invention to provide a switch-equipped coaxial connector so that, with a simple configuration, increase in the size thereof can be avoided, usage durability can be improved, and occurrence of insufficient electrical connection caused by dust that has entered the interior thereof can be prevented well.

The present invention for achieving the above described object employs a configuration in which a switch-equipped coaxial connector has a pair of contacts disposed so as to be extended like cantilevers from fixing parts fixed with an insulating housing and be opposed to each other, the contacts disposed so that end parts of the pair of the contacts are in contact with each other, the switch-equipped coaxial connector configured so that pressing force of an opposing connector inserted through an insertion hole provided in the insulating housing moves a first-side contact of the pair of the contacts in a pressing direction and separates the first-side contact from a second-side contact of the pair of the contacts; wherein both of the pair of the contacts respectively have flexible elastic beam-like members extended like cantilevers from the fixing parts; the elastic beam-like member of at least the first-side contact of the pair of the contacts has a crank part bent toward an inserting direction of the opposing connector; in both of the contacts, cut-away parts that substantially increase span lengths of the elastic beam-like members are respectively formed at boundary parts between the fixing parts and the elastic beam-like members; and gaps that ensure flexibility of the elastic beam-like members are provided respectively between both of the contacts and the insulating housing.

According to the switch-equipped coaxial connector having such a configuration, the crank part provided in at least the first-side contact and the cut-away parts provided on both of the contacts enhance elasticity of the contacts with respect to the pressing force of the opposing connector. The gaps provided between the contacts and the insulating housing ensure flexibility of both of the contacts, and permanent deformation of the contacts is prevented even when the size and height of the connector are reduced. Even when dust which has entered the interior thereof falls on the contacts through the opposing insertion hole, which is open when the opposing connector is not mated therewith, the dust is moved along the inclined surface of the crank part of the contact and is not accumulated on the contacts. The risk that electrical conductivity between the opposing connector and the contacts and the electrical conductivity mutually between the contacts are disturbed by the dust is reduced.

It is desired that the fixing part of the present invention be extended in a direction in which the pair of contacts are opposed to each other and engaged with the insulating housing.

According to the switch-equipped coaxial connector having such a configuration, the fixing parts provided in both of the contacts are fixed to the insulating housing in a state that the fixing parts are extended in the contact opposing direction. Therefore, supportability of the contacts with respect to the inserting direction of the opposing connector is improved, positional accuracy at electrical contact parts is improved, wobbling stability of the contacts is improved, and positional misalignment of the contacts is prevented with respect to the pressing force of the opposing connector and that mutually between the contacts.

It is also desired that the cut-away part of the present invention be formed so as to form a groove shape at a coupling part between the fixing part and the elastic beam-like member.

According to the switch-equipped coaxial connector having such a configuration, the substantial span length of the elastic beam-like member is increased by the length of the groove constituting the cut-away part. Therefore, elasticity of the elastic beam-like member is easily improved, the flexure supporting point of the elastic beam-like member is positioned in the length-direction range of the fixing part, and the retainability of the elastic beam-like member by the fixing part is improved.

It is also desired that the crank part of the present invention be configured so as to be obliquely bent and extended from an intermediate position in an extending direction of the elastic beam-like member toward the inserting direction of the opposing connector and then obliquely bent toward a direction opposite to the inserting direction of the opposing connector; and a distal end part of the elastic beam-like member extended from the crank part be disposed so as to be brought into contact with the second-side contact from a direction opposite to the inserting direction of the opposing connector.

According to the switch-equipped coaxial connector having such a configuration, the distal end part of the first-side contact is brought into contact with the second-side contact as if scooping-up the second-side contact, and the contact parts of both of the contacts are brought into contact with each other so as to be sliding contact upon insertion/detachment of the opposing connector. Therefore, the state of electrical connection is maintained well, and cleanliness at the contact parts is improved by a so-called wiping action mutually between the contacts.

It is also desired that, in the elastic beam-like member of the first-side contact of the present invention, a through hole be formed at a part to be brought into contact with the opposing connector.

According to the switch-equipped coaxial connector having such a configuration, dust such as debris which has fallen on the first-side contact is discharged to the outside through the through hole, the inner peripheral part of the through hole is brought into contact with the opposing connector from both sides of the diagonal-line direction of the through hole, and performance of contact between the opposing connector and the contact is improved.

As described above, in the switch-equipped coaxial connector according to the present invention, both of the contacts extended like the cantilevers in the insulating housing are formed of the elastic beam-like members, the crank part is provided in at least the first-side contact, and both of the contacts are provided with the cut-away parts, which substantially increase the span lengths of the elastic beam-like members, and the gaps between the contacts and the insulating housing, which ensure flexibility of the elastic beam-like members; thereby employing a configuration in which: flexibility is ensured while enhancing elasticity of the contacts, permanent deformation of the contacts is prevented, the dust which has entered the interior thereof is moved along the crank part, electrical conductivity is ensured well. Therefore, with a simple configuration, increase in size can be avoided, usage durability can be improved, occurrence of insufficient electrical connection due to dust can be prevented well, and reliability of the switch-equipped coaxial connector can be significantly improved.

DETAILED DESCRIPTION OF THE PREFERRED EMBODIMENT

Hereinafter, an embodiment in which a switch-equipped coaxial connector according to the present invention is employed as a circuit test switch will be explained in detail based on drawings.

[About Overall Structure of Circuit Test Switch]

The switch-equipped coaxial connector 10 according to a first embodiment of the present invention shown in FIG. 1 to FIG. 6 and FIG. 10 to FIG. 12 is mounted on a wiring board, of which illustration is omitted, and a test plug connector 20 (see FIG. 11 and FIG. 12) serving as an opposing connector is configured to be mated with the switch-equipped coaxial connector 10 from the upper side or removed therefrom toward the upper side. More specifically, the test plug connector 20 disposed in the upper side of the switch-equipped coaxial connector 10 is thrust into the switch-equipped coaxial connector 10 in the lower side with appropriate force while being held by hands of an operator, and an attached state that both of the connectors are mated with each other is obtained as a result. When the test plug connector 20 is held in the attached state of both of the connectors and pulled up to the upper side with appropriate force, the test plug connector is detached upward from the switch-equipped coaxial connector 10 to carry out removal. The test plug connector 20 is not limited to be inserted/removed by the hands of the operator, but may be automatically inserted/removed by a machine. Hereinafter, the inserting direction and the removing direction of the test plug connector will be referred to as "downward direction" and "upward direction".

The switch-equipped coaxial connector 10, which constitutes an assembly of such a circuit test switch, is used by, for example, being mounted by soldering on an electronic circuit board (illustration omitted) provided on an electronic device such as a mobile phone. The connector 10 is disposed so as to disconnect or connect an electronic circuit, which is provided on the electronic device, to, for example, a main body side of the device and an antenna side.

[About Configuration of Insulating Housing]

Figure 10:
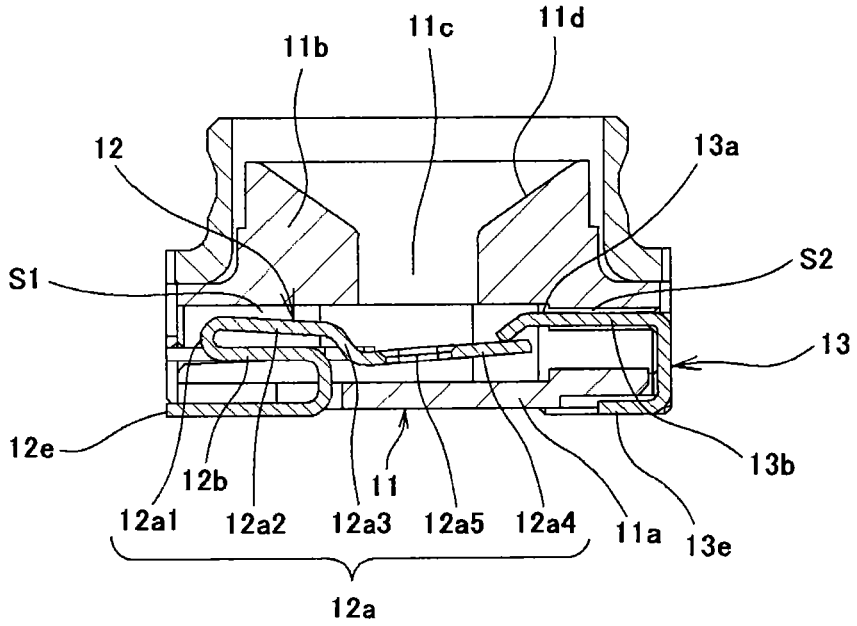
FIG. 10 is a vertical cross-sectional explanatory drawing taken along a line A-A of FIG. 3.
Figure 11:
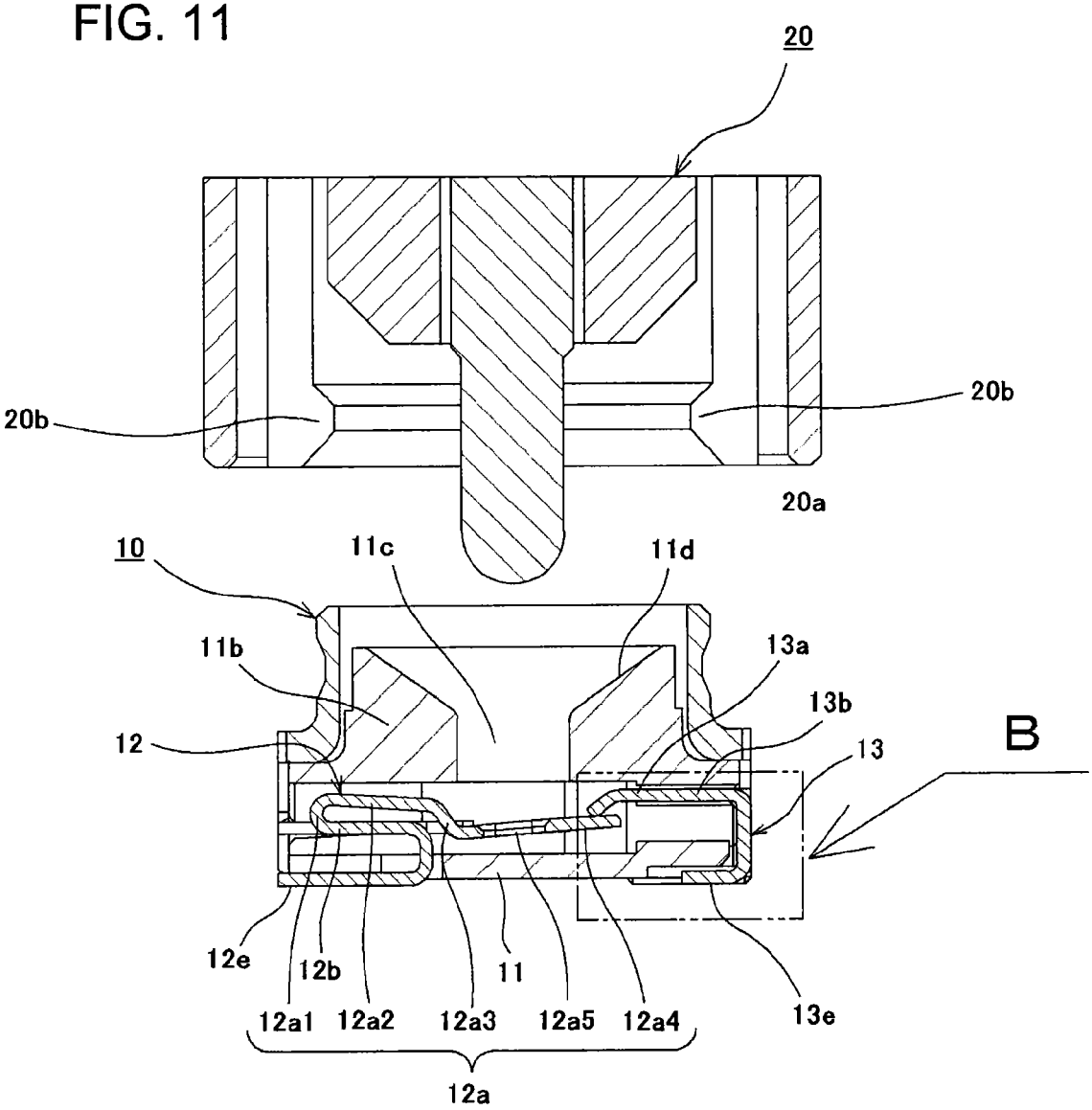
FIG. 11 is a vertical cross-sectional explanatory drawing which is a drawing corresponding to FIG. 10 and showing a state immediately before insertion of an opposing connector (test plug connector)
Figure 12:
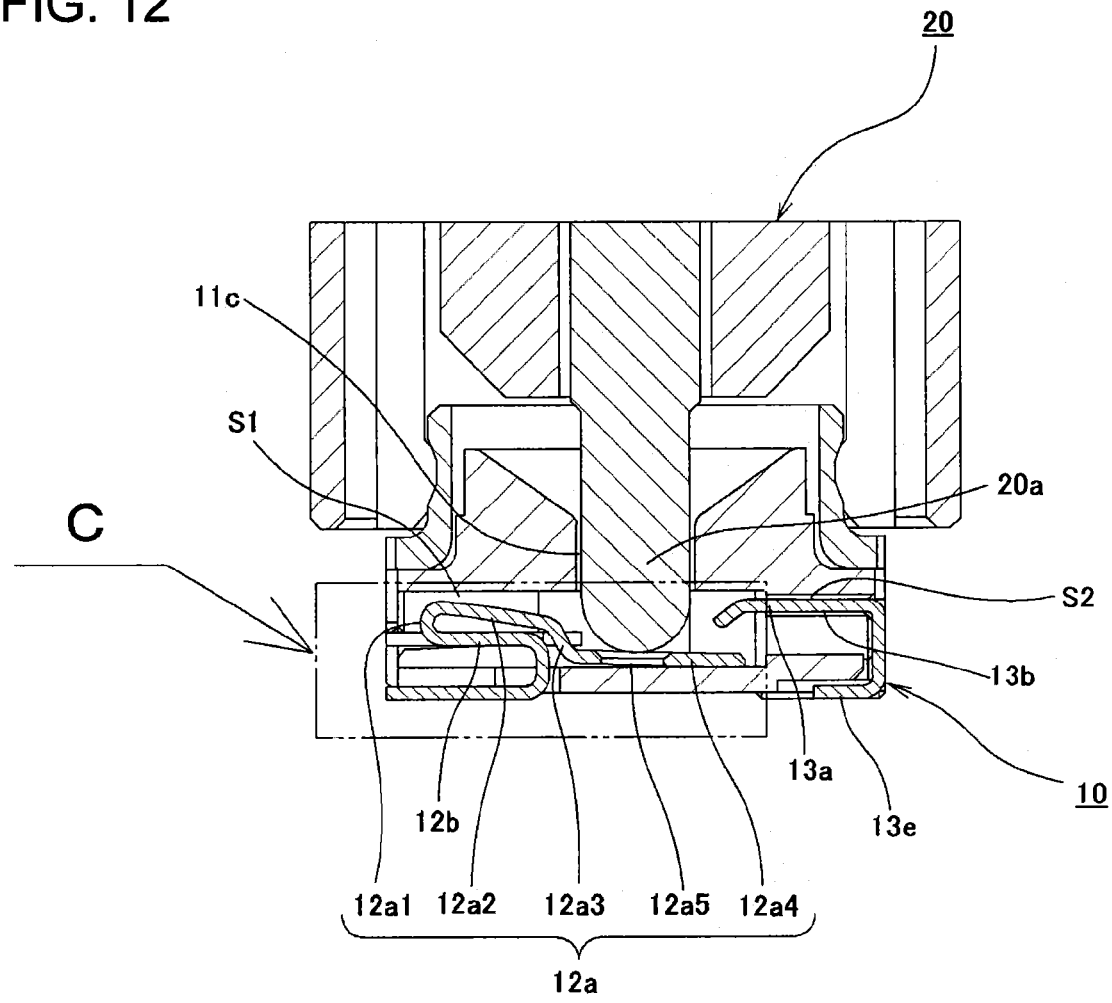
FIG. 12 is a vertical cross-sectional explanatory drawing showing a state in which the opposing connector (test plug connector) is inserted in the state of FIG. 11.
Figure 13:
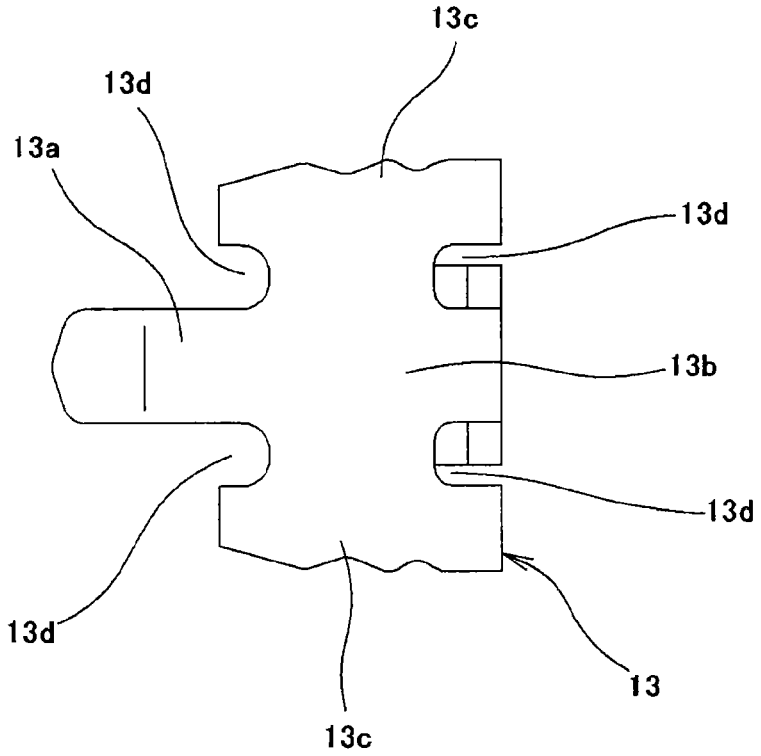
FIG. 13 is a plan explanatory drawing showing the structure of the second-side contact used in the switch-equipped coaxial connector according to the embodiment of the present invention shown in FIG. 1 to FIG. 12.
Figure 14:
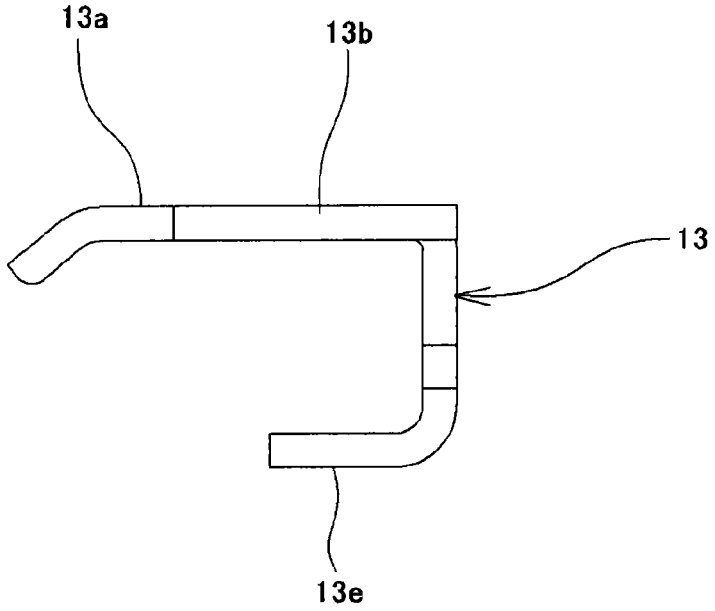
FIG. 14 is a lateral-side explanatory drawing showing, from a lateral direction, the second-side contact shown in FIG. 13.
Figure 15:
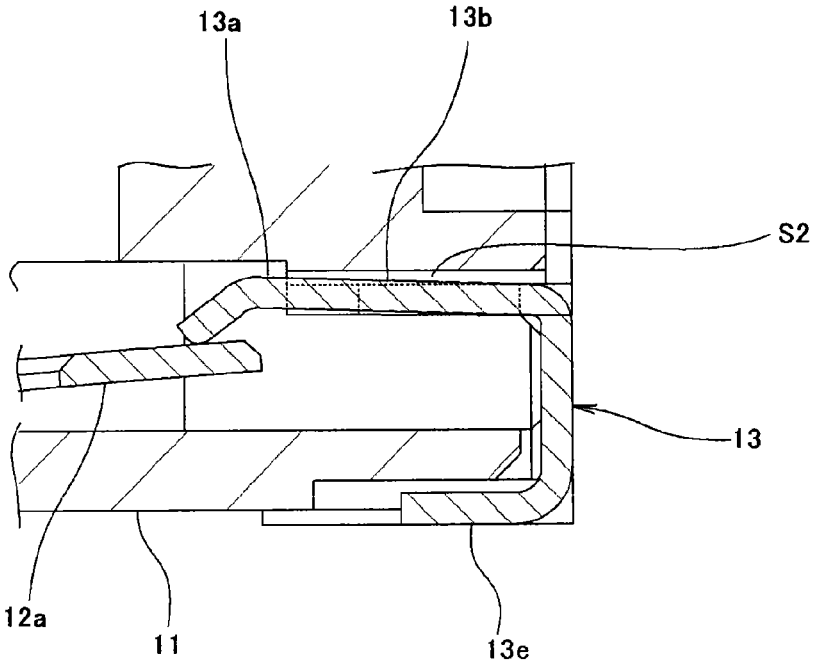
FIG. 15 is a partial vertical cross-sectional explanatory drawing showing a part B of FIG. 10 in an enlarged manner.
Figure 16:
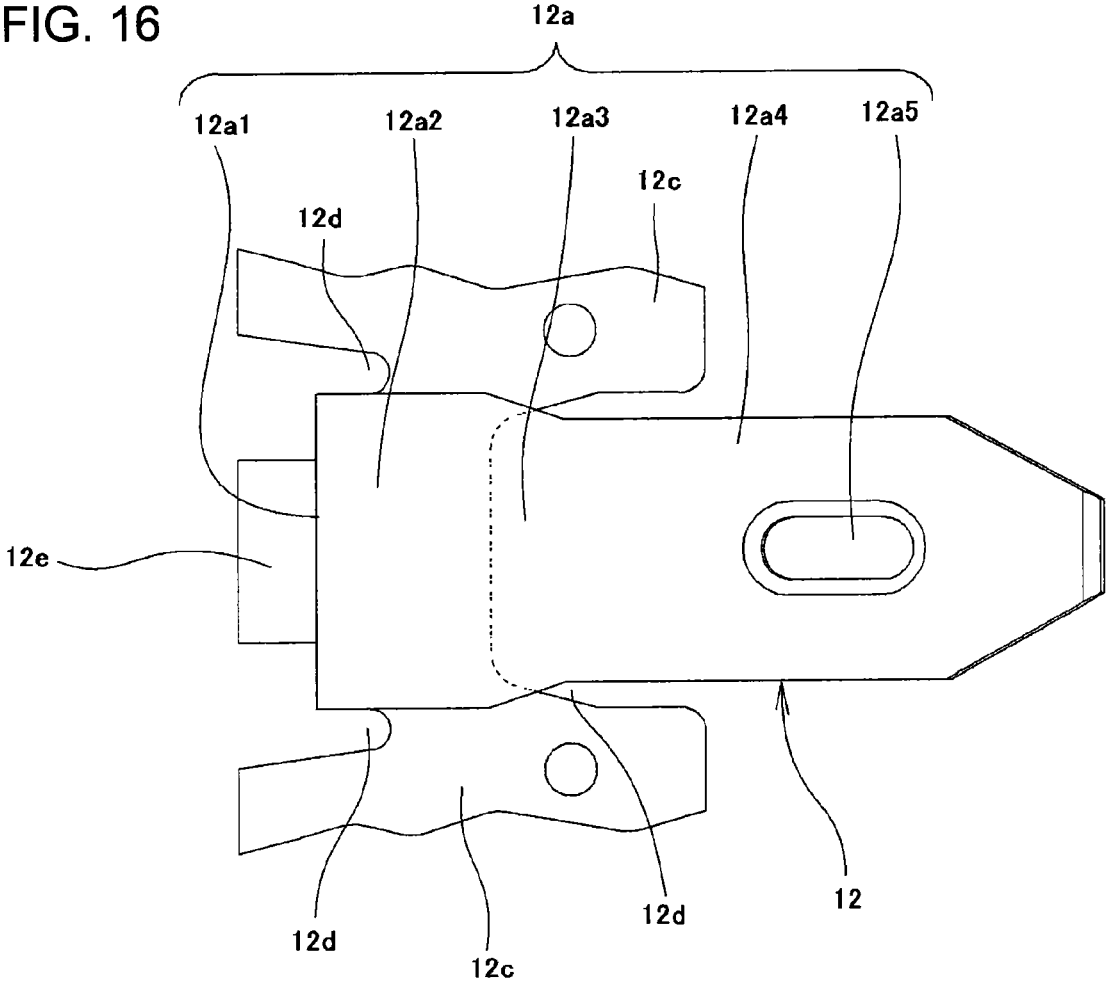
FIG. 16 is a plan explanatory drawing showing the structure of the first-side contact used in the switch-equipped coaxial connector according to the embodiment of the present invention shown in FIG. 1 to FIG. 12.
Figure 17:
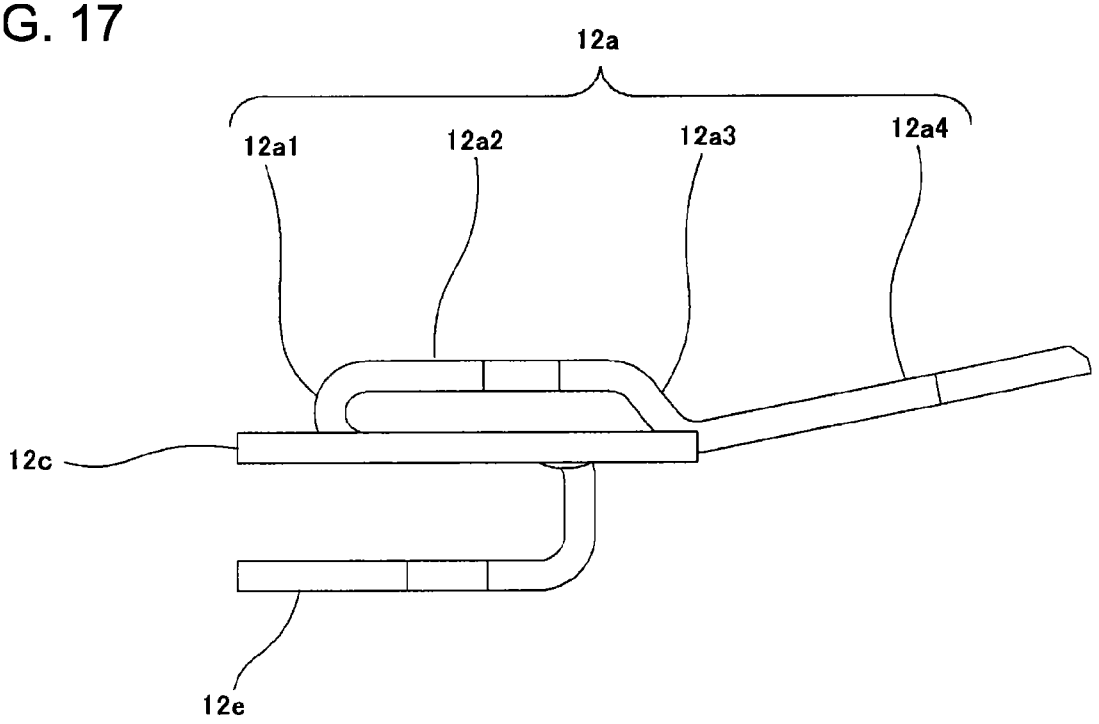
FIG. 17 is a lateral-side explanatory drawing showing, from a lateral direction, the first-side contact shown in FIG. 16.
Figure 18:
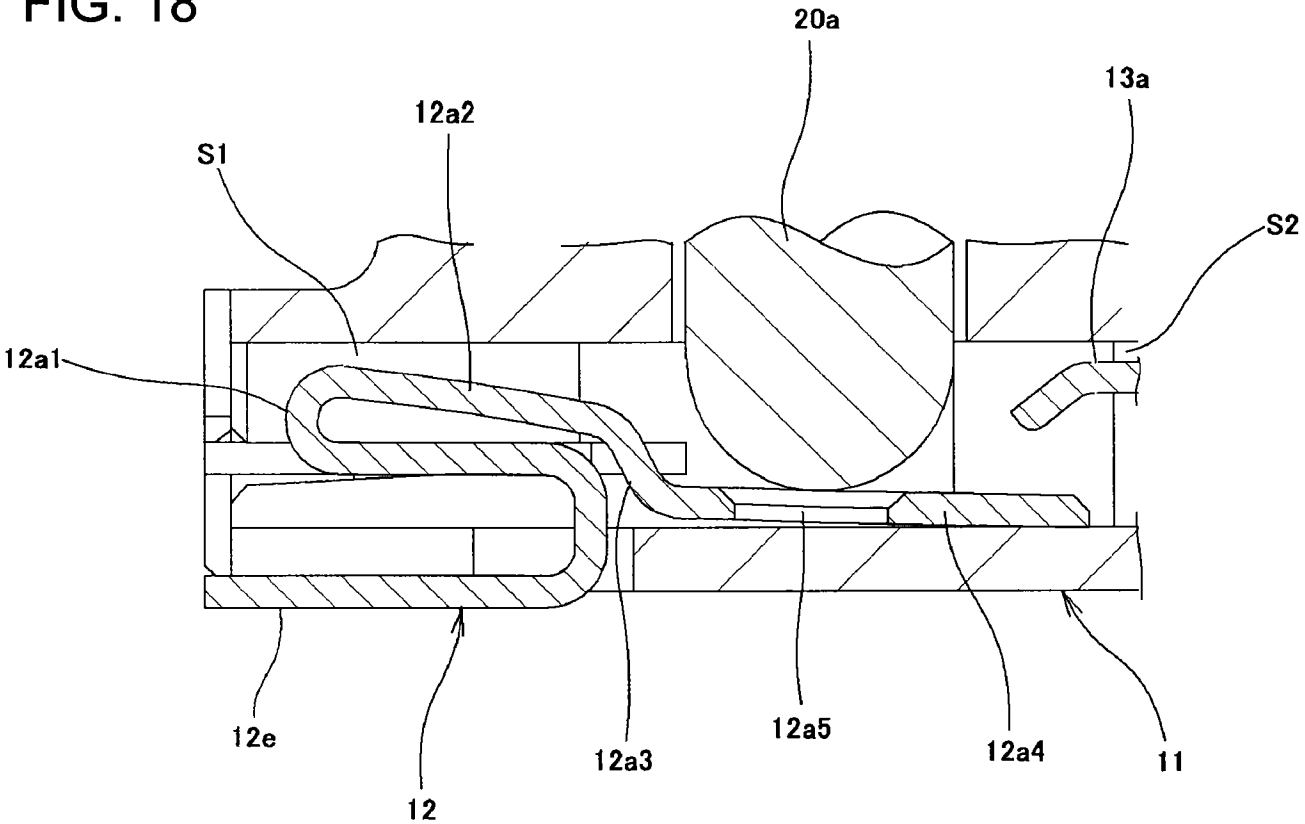
FIG. 18 is a partial vertical cross-sectional explanatory drawing showing a part C of FIG. 12 in an enlarged manner.
Figure 19:
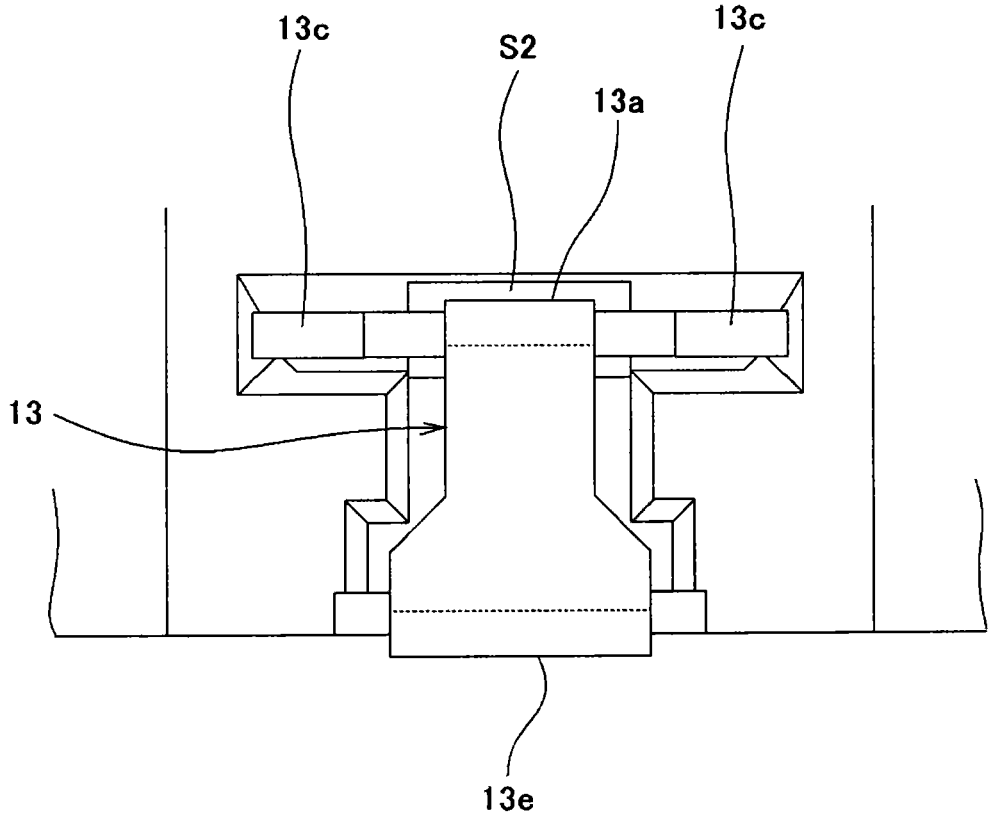
FIG. 19 is a front explanatory drawing showing an attached state of the first-side contact shown in FIG. 18 in an enlarged manner.

As shown in FIG. 10 to FIG. 12, an insulating housing 11, which constitutes a main body part of the above described switch-equipped coaxial connector 10, is formed by, for example, molding by using a resin material such as plastic. The insulating housing 11 integrally has a base frame part 11*a*, which is composed of a plate-like member having an approximately rectangular shape in a plane, and an insertion guide part 11*b*, which is disposed at a center part of an upper surface of the base frame part 11*a*.

The insertion guide part 11*b* is formed so as to rise upward from an upper-side surface of the above described base frame part 11*a* to form an approximately cylindrical shape. An inner-peripheral-side surface of the insertion guide part 11*b* is formed so as to form an approximately funnel-like shape, and an inclined guide surface 11*d*, which is obliquely extended downward toward an upper-surface-side opening of a probe insertion hole 11*c* provided at a center part as an opposing insertion hole, is formed from a circular outer edge part formed at an upper edge part of the insertion guide part 11*b*. The inclined guide surface 11*d* has a function of guiding a probe 20*a*, which is provided on the above described test plug connector 20, toward the probe insertion hole 11*c*. Even in the case in which the probe 20*a* of the test plug connector 20 is not disposed immediately above the probe insertion hole 11*c*, when a distal end part of the probe abuts on the inclined surface of the inclined guide surface 11*d*, the distal end part of the probe 20*a* is configured to be moved so as to slide down downward along the inclined guide surface 11*d* and be smoothly guided to the probe insertion hole 11*c*.

The probe insertion hole 11*c* provided as the opposing insertion hole is extended downward along the central axis of the base frame part 11*a* from an upper-end opening of the insertion guide part 11*b* as described above, and the probe insertion hole 11*c* is provided so as to be formed from the upper side with respect to a contact insertion path, which is provided so as to penetrate through the part between a front surface and a back surface of the insulating housing 11. The probe insertion hole 11*c* is disposed so as to be positioned at the top of one of later-described contacts 12, and is formed so as to form an approximately circular shape in a plane, the shape having a size having an inner diameter that allows insertion of the probe 20*a* of the test plug connector 20. The above described insertion guide part 11*b* is disposed around the upper-surface-side opening of the probe insertion hole 11*c* so as to be approximately concentric thereto.

[About Configuration of Contacts]

On the other hand, as shown in FIG. 7 to FIG. 10, a first contact (first-side contact) 12 and a second contact (second-side contact) 13 for signal transmission are attached by being inserted into the contact insertion path, which is provided in the base frame part 11*a* of the insulating housing 11, so as to be opposed to each other in a horizontal direction approximately orthogonal to the inserting/removing direction (vertical direction) of the above described test plug connector (opposing connector) 20. Hereinafter, the direction in which the first contact 12 and the second contact 13 are opposed to each other will be simply referred to as "contact opposing direction". Also, the direction in which the contacts 12 and 13 are opposed to each other will be referred to as "front", and the direction opposite thereto will be referred to as "rear".

The first contact 12 and the second contact 13 constitute a so-called contact pair and are inserted so as to face the interior of the contact insertion path from both end surface sides of the front surface and the back surface of the insulating housing 11, and the contacts are attached to the insulating housing 11 so that both of the contacts 12 and 13 are in a state that they are elastically in contact with each other. The contact state between both of the contacts 12 and 13 is cancelled by mating of the test plug connector 20 to obtain a separated state as described later.

The above described first contact 12 and the second contact 13 have elastic beam-like members 12*a* and 13*a*, both of which have flexibility. Both of the elastic beam-like members 12*a* and 13*a* are extended like cantilevers from supporting boards 12*b* and 13*b*, which are retained in an approximately fixed state as described later, toward the front which is the contact opposing direction. The structures of the elastic beam-like members 12*a* and 13*a* will be explained in detail in later paragraphs.

Figure 1:
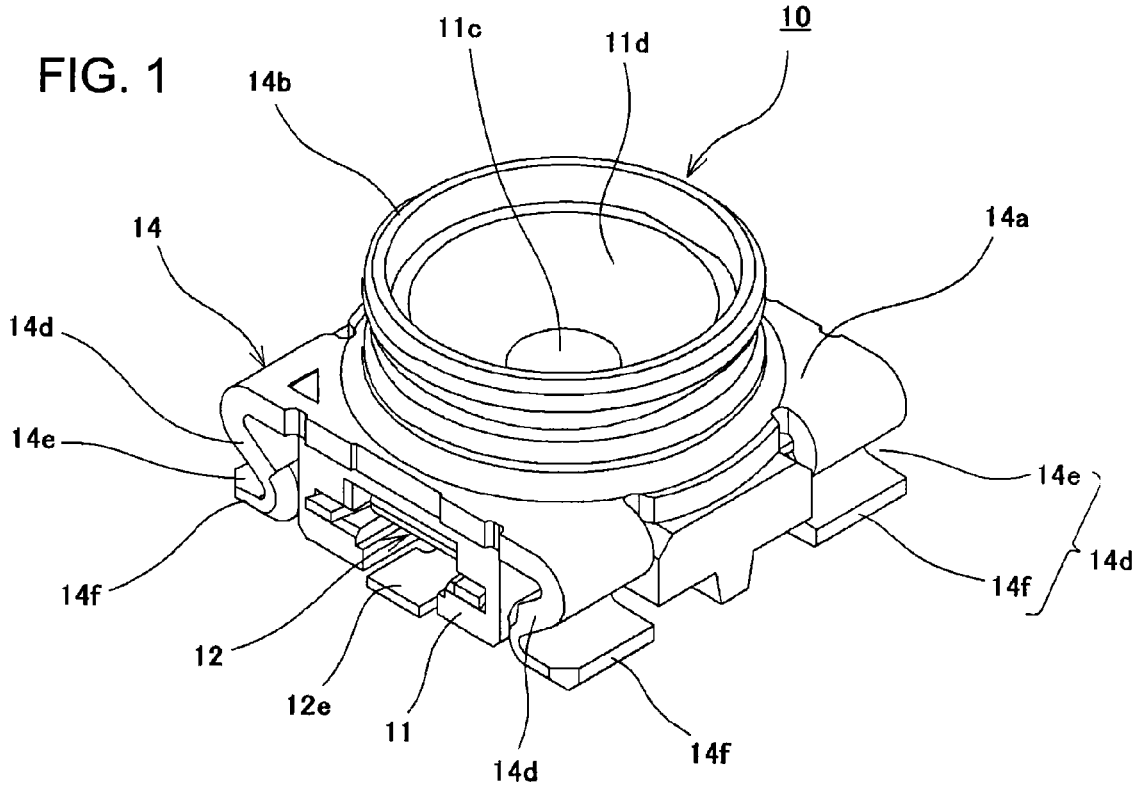
FIG. 1 is an external-appearance perspective explanatory drawing showing, from a front upper side, the overall structure of a switch-equipped coaxial connector constituting a circuit test switch according to an embodiment of the present invention.
Figure 2:
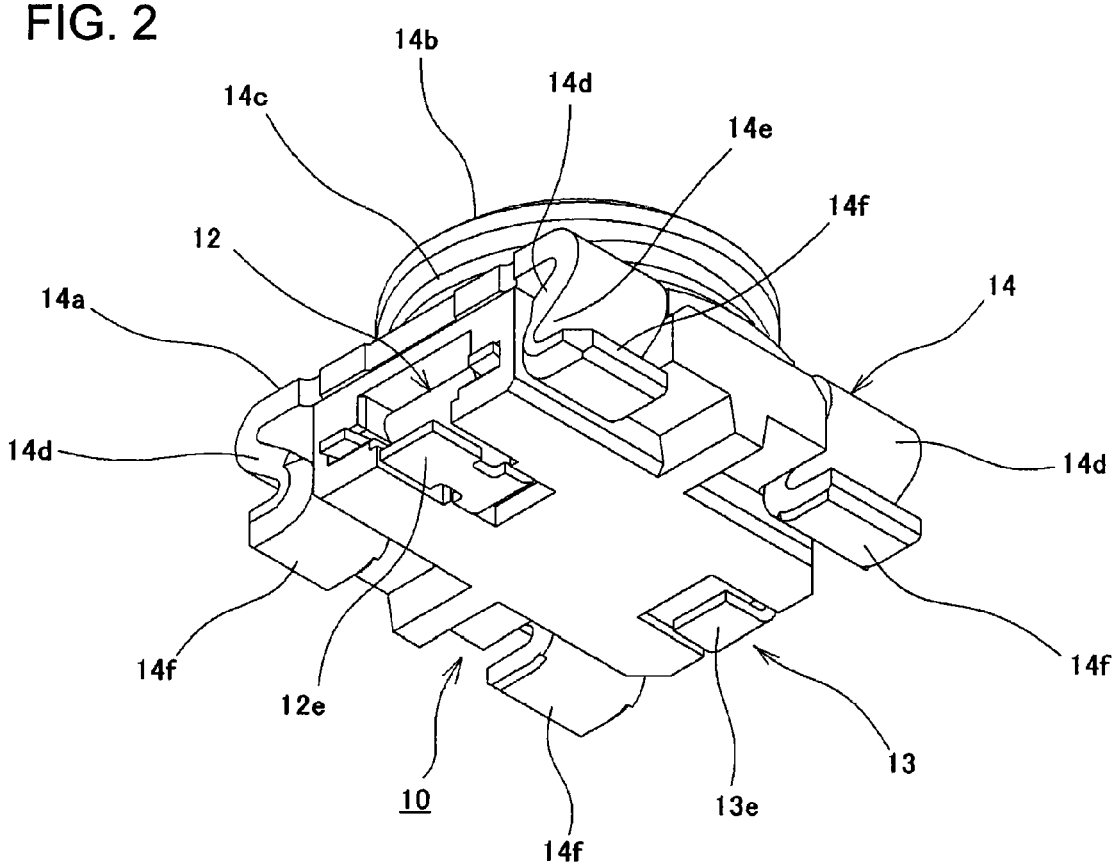
FIG. 2 is an external-appearance perspective explanatory drawing showing, from a front lower side, the overall structure of the switch-equipped coaxial connector according to the embodiment of the present invention shown in FIG. 1.
Figure 3:
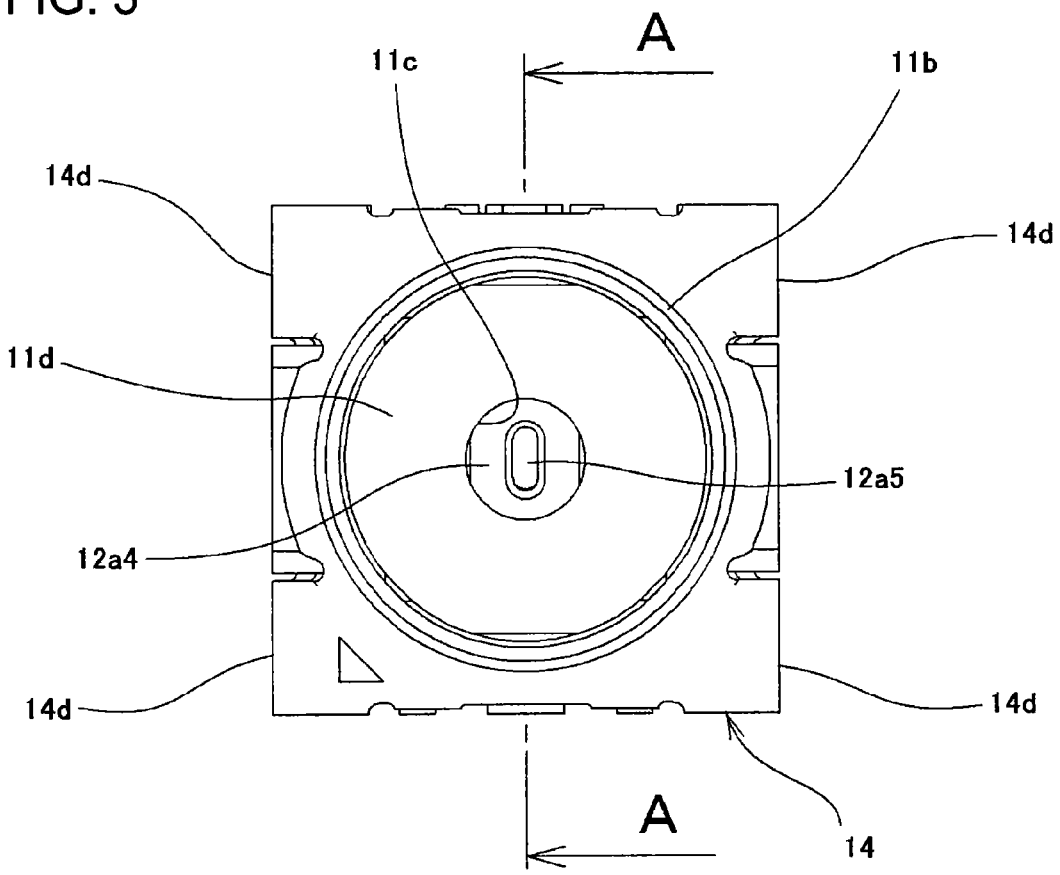
FIG. 3 is a plan explanatory drawing of the switch-equipped coaxial connector according to the embodiment of the present invention shown in FIG. 1 and FIG. 2.
Figure 4:
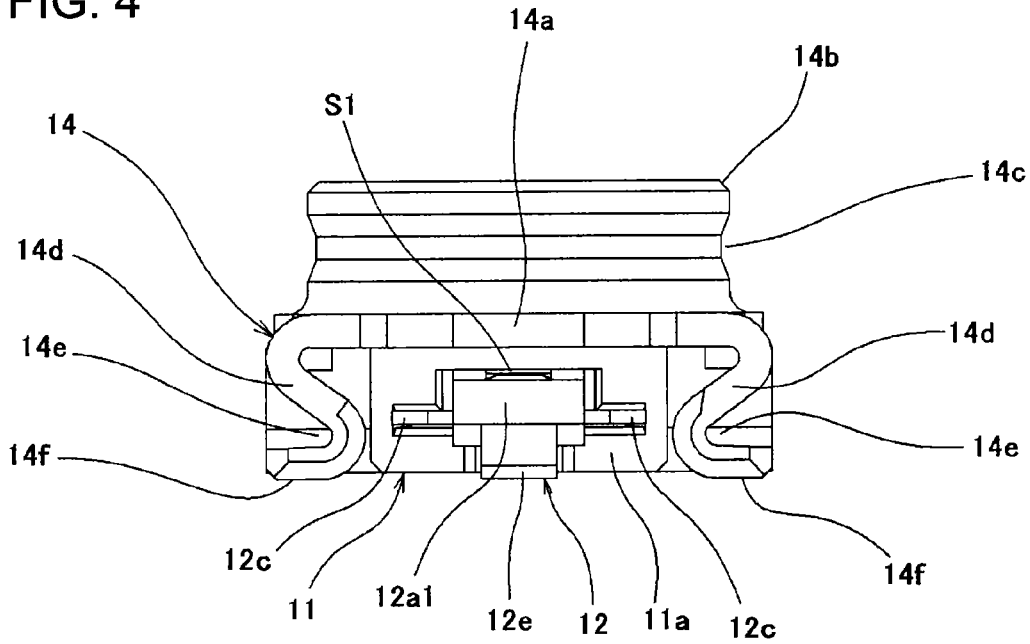
FIG. 4 is a front explanatory drawing of the switch-equipped coaxial connector according to the embodiment of the present invention shown in FIG. 1 to FIG. 3.
Figure 5:
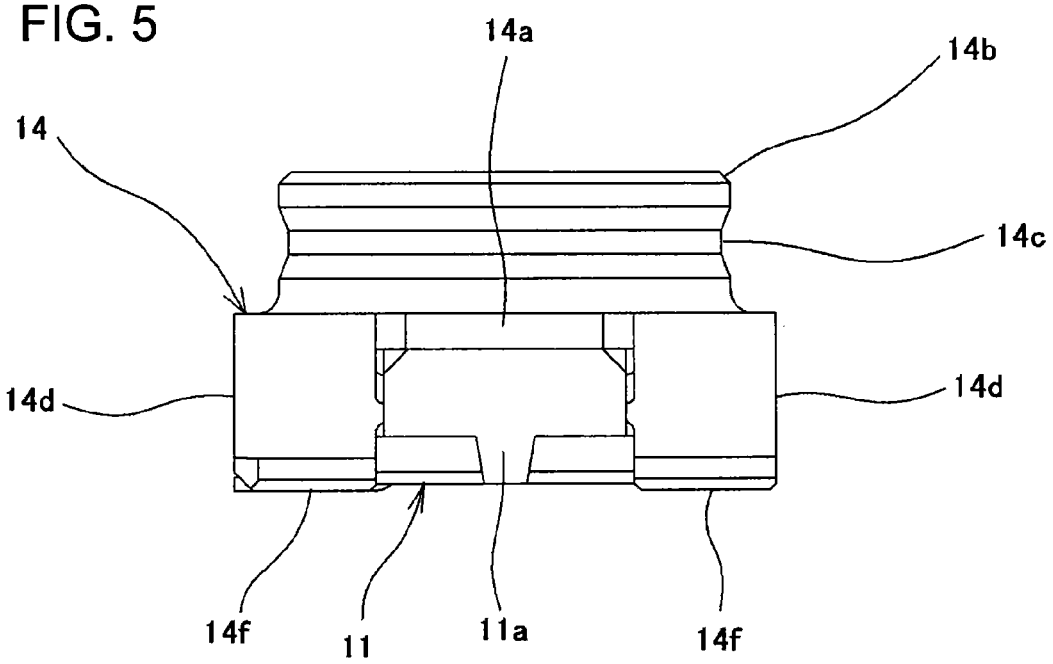
FIG. 5 is a lateral-side explanatory drawing of the switch-equipped coaxial connector according to the embodiment of the present invention shown in FIG. 1 to FIG. 3.
Figure 6:
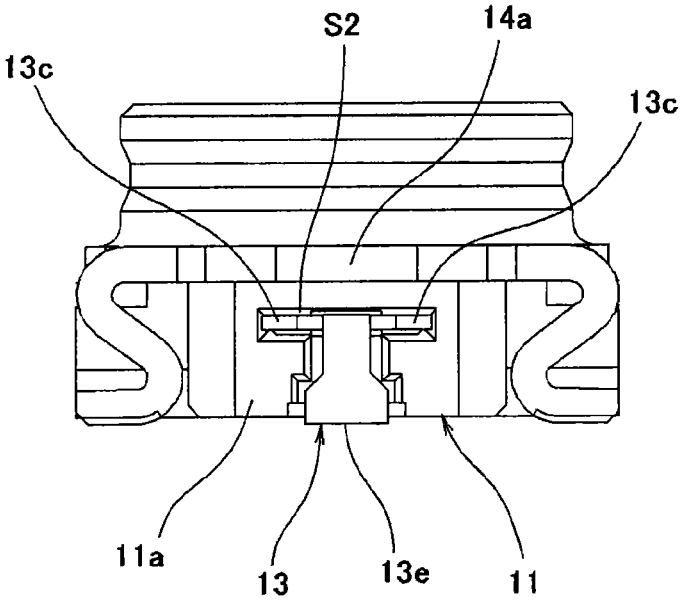
FIG. 6 is a back-side explanatory drawing of the switch-equipped coaxial connector according to the embodiment of the present invention shown in FIG. 1 to FIG. 3.
Figure 7:
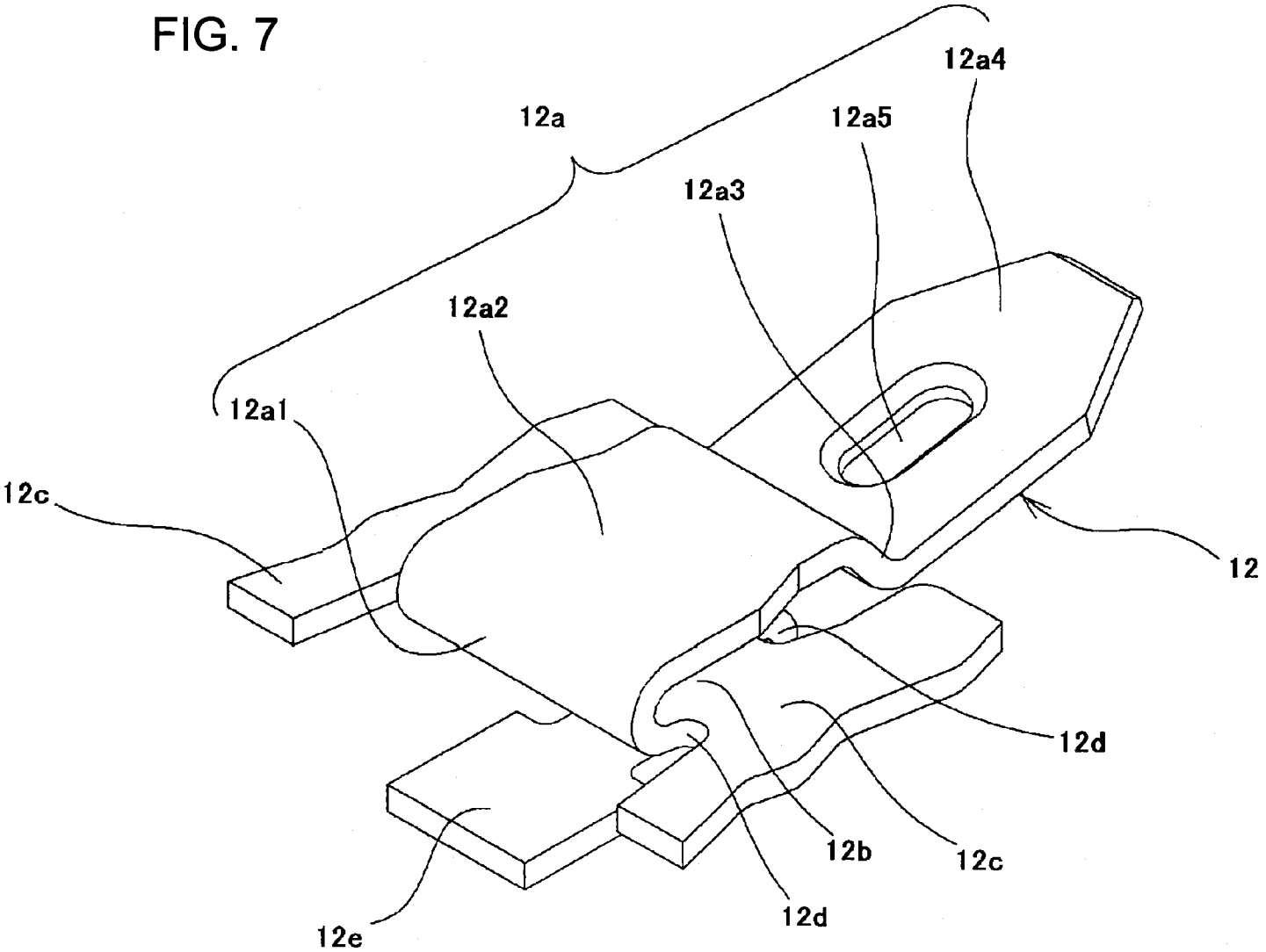
FIG. 7 is an external-appearance perspective explanatory drawing showing, from a front upper side, a first-side contact used in the switch-equipped coaxial connector according to the embodiment of the present invention shown in FIG. 1 to FIG. 6.
Figure 9:
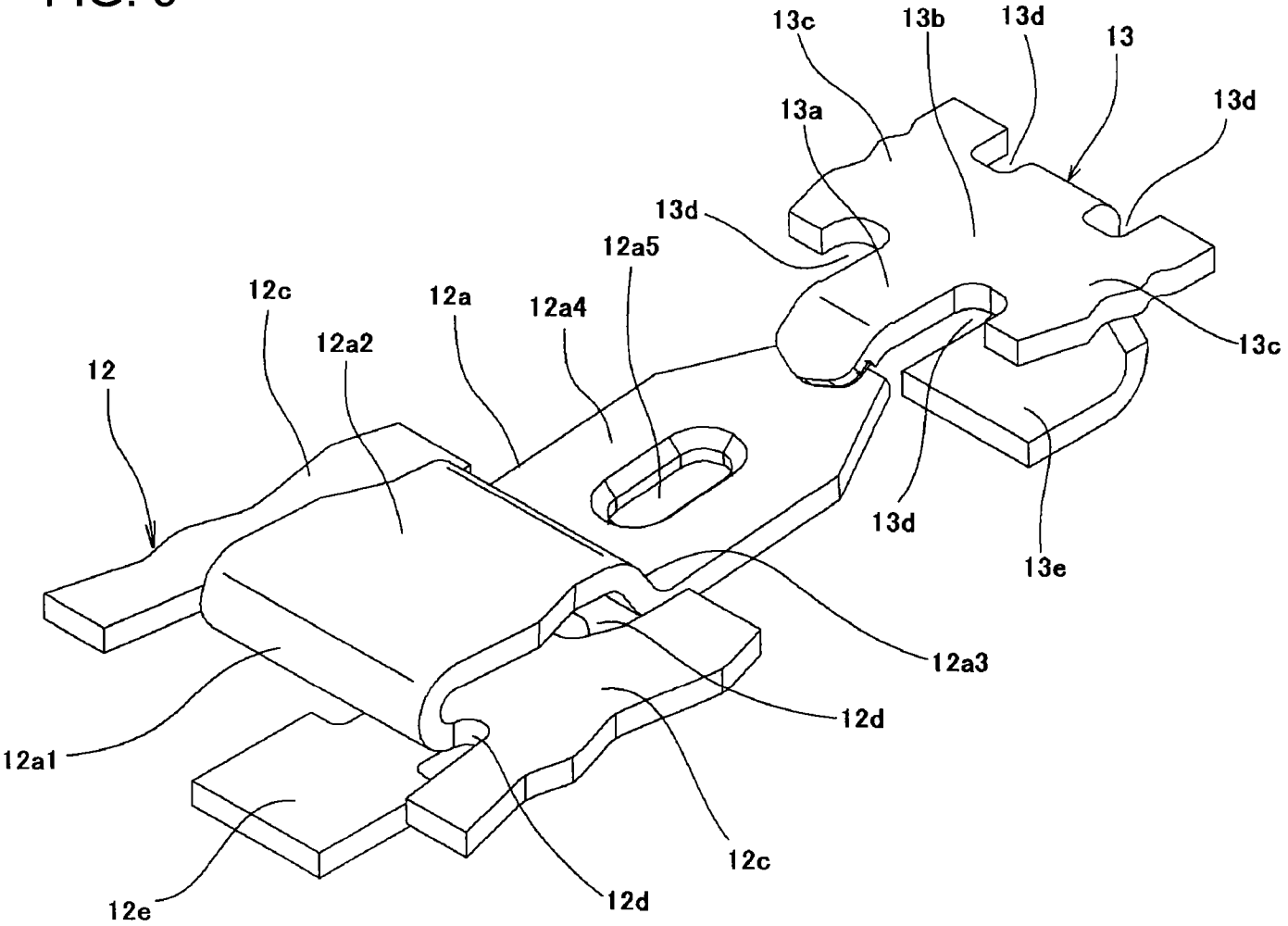
FIG. 9 is an external-appearance perspective explanatory drawing showing, from a front upper side, a disposing relation of both of the contacts used in the switch-equipped coaxial connector according to the embodiment of the present invention shown in FIG. 1 to FIG. 6.

Particularly as shown in FIG. 7 and FIG. 9, the supporting boards 12*b* and 13*b* are formed of plate-like members, which are extended approximately horizontally. Fixing pieces 12*c* and 13*c* serving as fixing parts with respect to the insulating housing 11 are extended approximately horizontally toward the outer sides of both sides from both-side edge parts of the supporting boards 12*b* and 13*b*, in other words, from both end pars in a board-width direction orthogonal to the contact opposing direction. These fixing pieces 12*c* and 13*c* are configured to be press-fitted in fixing groove parts dented so as to form groove-like shapes in a wall surface of the insulating housing 11, and the entirety of the first contact 12 and the second contact 13 is retained by the engaging force of the fixing pieces 12*c* and 13*c* with respect to the insulating housing 11.

Cut-away parts 12*d* and 13*d* extended along the contact opposing direction are formed at coupling boundary parts between both members where the above described fixing pieces 12*c* and 13*c* are coupled to the supporting boards 12*b* and 13*b*. The cut-away parts 12*d* and 13*d* are formed so as to cut away root parts of the above described elastic beam-like members 12*a* and 13*a* by predetermined lengths from both of the front side and the rear side thereof toward the rear side and the front side.

Among them, the cut-away parts 13*d* provided in the fixing piece 13*c* side are formed so that both of them in the front side and the rear side form thin groove shapes, while the cut-away parts 12*d* provided in the fixing pieces 12*c* side have different shapes in the front and the back. Specifically, the cut-away parts 12*d* disposed in the rear side are formed so as to form thin groove shapes; on the other hand, the cut-away part 12*d* disposed in the front side is formed so as to be recessed largely toward the rear side in an approximately U-shape across approximately the full width of the front edge part of the supporting board 12*b*. Since the cut-away parts 12*d* and 13*d* are provided, the widths of the coupling parts between the fixing pieces 12*c* and 13*c* and the supporting boards 12*b* and 13*b* are reduced. Corresponding to the amounts of thus-reduced widths, in other words, by the lengths of the cut-away parts 12*d* and 13*d*, the later-described span lengths of the elastic beam-like members 12*a* and 13*a* are configured to be substantially increased.

Thus, in the present embodiment, the elastic beam-like member 12*a* of the first contact 12 is configured to be extended to the second contact 13 side of the opposing side with intermediation of a bent part 12*a*1 formed by bending into an approximately U-shape from a rear-side edge part of the supporting board 12*b*. Therefore, the substantial span length of the elastic beam-like member 12*a* is increased particularly by providing the rear-side cut-away parts 12*d*. On the other hand, the elastic beam-like member 13*a* of the second contact 13 is configured to be directly extended from a front edge part of the supporting board 13*b* toward the first contact 12 of the opposing side. Therefore, the substantial span length of the elastic beam-like member 13*a* is increased particularly by forming the front-side cut-away parts 13*d*. Therefore, if the first contact 12 is configured to be directly extended from the front edge part of the supporting board 12*b* toward the second contact 13 of the opposing side, front-side cut-away parts 12*d* should be formed.

Furthermore, in the above described supporting boards 12*b* and 13*b*, edge parts in the opposite side of the edge parts from which the elastic beam-like members 12*a* and 13*a* are projecting, in other words, each of a front edge part of the supporting board 12*b* of the first contact 12 and a rear edge part of the supporting board 13*b* of the second contact 13 is approximately perpendicularly bent downward, and the board connecting part 12*e* or 13*e* is approximately horizontally extended from a lower end part of the approximately-perpendicularly bent downward part. The board connecting part 12*e* provided in the first contact 12 side is extended toward the rear side which is in the opposite side of the connector opposing direction, and the board connecting part 13*e* provided in the second contact 13 side is extended toward the front side which is the connector opposing direction. Lower surfaces of the board connecting parts 12*e* and 13*e* are configured to be solder-joined with electrically conductive paths for signal transmission provided on the above described wiring board so as to carry out mounting.

The above described elastic beam-like member 12*a* of the first contact 12 and the elastic beam-like member 13*a* of the second contact 13 are formed of belt-like spring members which are like cantilevers projecting so as to be close to each other. The elastic beam-like member 13*a* of the second contact 13 among them is configured to be directly extended from the front edge part of the above described supporting board 13*b* toward the first contact 12 of the opposing side. On the other hand, the elastic beam-like member 12*a* of the first contact 12 is configured to be extended from the rear-side edge part of the supporting board 12*b* to the second contact 13 side of the opposing side with intermediation of the bent part 12*a*1, which is formed by bending into an approximately U-shape.

More detailed explanation will be given. In the elastic beam-like member 12*a* of the first contact 12, a horizontal extending part 12*a*2 extended from the above described bent part 12*a*1 is approximately horizontally extended at a position above the supporting board 12*b* toward the front side, which is in the connector opposing direction. A crank part 12*a*3 bent obliquely downward is integrally continued to the front side of the horizontal extending part 12*a*2. Furthermore, a main beam part 12*a*4 is configured to be extended toward the front side, which is the connector opposing direction, via the crank part 12*a*3. The entirety of the elastic beam-like member 12*a* like this has elastic flexibility using the bent part 12*a*1 or a vicinity thereof as a supporting point and is configured to be swung about the supporting point in the vertical direction.

In this case, the horizontal extending part 12*a*2 of the elastic beam-like member 12*a* is disposed so as to be extended along the upper wall surface of the contact insertion path provided in the above described insulating housing 11, and a gap S1, which ensures flexibility of the elastic beam-like member 12*a*, is provided between the horizontal extending part 12*a*2 of the elastic beam-like member 12*a* and the upper wall surface of the insertion path of the insulating housing 11.

The crank part 12*a*3 provided in the elastic beam-like member 12*a* is obliquely bent and extended from an intermediate position in the extending direction of the elastic beam-like member 12*a* toward the lower side which is the insertion direction of the above described test plug connector (opposing connector) 20, and the crank part 12*a*3 is configured to be obliquely bent to the upper side which is the opposite direction of the insertion direction of the test plug connector 20 from a lower end part thereof which is an extended end obliquely below thereof. A downward step is formed at an intermediate part of the elastic beam-like member 12*a* by the crank part 12*a*3 like this, and elasticity of the entire elastic beam-like member 12*a* is improved.

Furthermore, the above described main beam part 12*a*4 is approximately linearly extended obliquely upward from a lower end part of the crank part 12*a*3 provided in the first contact 12 toward the front side, which is the connector opposing direction. A contact part is provided at an extended-side distal end part of the main beam part 12*a*4, and the contact part provided in the elastic beam-like member 12*a* of the first contact 12 is brought into contact with a later-described contact part, which is provided on the elastic beam-like member 13*a* of the second contact 13, from the lower side. Both of these contact parts are subjected to elastic contact by elastic biasing force of both of the elastic beam-like members 12*a* and 13*a*.

The main beam part 12*a*4, which constitutes the elastic beam-like member 12*a* of the first contact 12, is disposed so as to be extended at a position immediately below the above described probe insertion hole 11*c*, and the lower-end opening of the probe insertion hole 11*c* is in a positional relation that the lower-end opening faces an intermediate part of the main beam part 12*a*4 from the upper side. When the test plug connector 20 is subjected to mating from the upper side to insert the probe 20*a* of the test plug connector 20 into the connector through the probe insertion hole 11*c* particularly as shown in FIG. 11 and FIG. 12, the probe 20*a* projecting downward from the probe insertion hole 11*c* abuts the intermediate part of the main beam part 12*a*3, which constitutes the elastic beam-like member 12*a* of the first contact 12, from the upper side. Furthermore, when the test plug connector 20 is pushed down to the lower side, the contact part provided on the elastic beam-like member 12*a* of the first contact 12 is configured to be separated downward from the contact part provided on the elastic beam-like member 13*a* of the second contact 13 by the pressing force of the probe 20*a*.

A through hole 12*a*5, to which the probe 20*a* of the test plug connector 20 is brought into contact from the upper side in this process, is formed to be like a slit at the intermediate position of the main beam part 12*a*4, which constitutes the elastic beam-like member 12*a* of the first contact 12, in other words, at a position that abuts the probe 20*a* of the test plug connector 20. The through hole 12*a*5 is formed of a long hole extended to be thin and long along the longitudinal direction of the main beam part 12*a*4 and is provided so as to be extended in a front-back direction from the position immediately below the above described probe insertion hole 11*c*.

As a result of providing the through hole 12*a*5 in the main beam part 12*a*4 constituting the elastic beam-like member 12*a* of the first contact 12 in this manner, dust such as debris that enters the interior thereof through the probe insertion hole (opposing insertion hole) 11*c* which is in an open state when the test plug connector 20 is not mated is guided downward particularly along the inclined surface of the main beam part 12*a*4 and discharged through the through hole 12*a*5. As a result, the dust is not accumulated on the first contact 12 or the second contact 13, and the risk that dust disturbs electrical conductivity between the first contact 12 and the second contact 13 is reduced.

An inclined surface, which is to be brought into contact with the probe 20*a* of the test plug connector 20, is provided at an opening edge part of the above described thorough hole 12*a*5. The opening edge part of the through hole 12*a*5 is configured to be brought into contact with, in an approximately tangential direction, a curved surface formed at a distal end-side part of the probe 20*a* of the test plug connector 20 and abut the probe 20*a* at multiple points from both sides of a diagonal-line direction of the through hole 12*a*5.

When such a configuration is employed, the electrical connection between the probe 20*a* of the test connector 20 and the first contact 12 is established well, and the dust discharged through the through hole 12*a*5 is smoothly guided by the inclined surface of the through hole 12*a*5. The stress caused when the probe 20*a* of the test connector 20 is brought into contact with the elastic beam-like member 12*a* of the first contact 12 is dispersed without being concentrated at part of the fixing pieces 12*c* of the first contact 12, and usage durability of the first contact 12 is improved.

Figure 8:
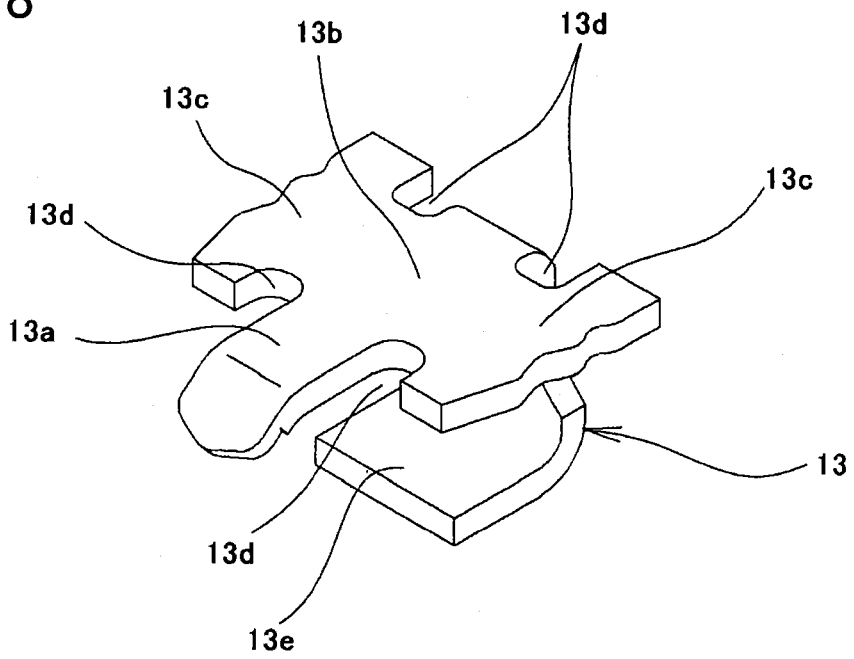
FIG. 8 is an explanatory-appearance perspective explanatory drawing showing, from a front upper side, a second-side contact used in the switch-equipped coaxial connector according to the embodiment of the present invention shown in FIG. 1 to FIG. 6.

On the other hand, as shown in FIG. 8 and FIG. 10, the elastic beam-like member 13*a* of the second contact 13 is configured to be directly extended from the front edge part of the supporting board 13*b* toward the first contact 12 of the opposing side as described above and is bent obliquely downward after approximately horizontally extended toward the front side in the connector opposing direction. The entirety of the elastic beam-like member 13*a* has elastic flexibility using the coupling part with the supporting board 13*b* or the vicinity thereof as a supporting point and is configured to be swung about the supporting point in the vertical direction.

The horizontal extending part of the elastic beam-like member 13*a* is disposed so as to be extended along the upper wall surface of the contact insertion path provided in the above described insulating housing 11, and a gap S2 which ensures flexibility of the elastic beam-like member 13*a* is provided between the horizontal extending part of the elastic beam-like member 13*a* and the upper wall surface of the insertion path of the insulating housing 11.

Furthermore, the front end part of the elastic beam-like member 13*a* of the second contact 13 is obliquely bent downward and extended in the above described manner, and the contact part provided at the distal end part in the extended side obliquely therebelow is brought into contact with the contact part, which is provided in the elastic beam-like member 12*a* of the first contact 12, from the upper side as described above. Both of the contact parts at this point are configured to be in elastic contact with each other by the elastic biasing force of both of the elastic beam-like members 12*a* and 13*a*.

According to the switch-equipped coaxial connector 10 according to the present embodiment having such a configuration, elasticity with respect to the pressing force of the test plug connector 20 serving as the opposing connector is increased by the crank part 12*a*3, which is provided in the first contact 12, and the cut-away parts 12*d* and 13*d* provided in both of the first and second contacts 12 and 13; flexibility is ensured for both of the first and second contacts 12 and 13 by the gaps S1 and S2 provided between there and the insulating housing 11; and, even when the size and height of the connector are reduced, permanent deformation of the contacts 12 and 13 is prevented.

Particularly, in the present embodiment, the actual span lengths of the elastic beam-like members 12*a* and 13*a* constituting the first and second contacts 12 and 13 are increased by the lengths of the cut-away parts 12*d* and 13*d* provided at the fixing pieces 12*c* and 13*c*; therefore, elasticity of the elastic beam-like members 12*a* and 13*a* has been further increased. Moreover, since flexure supporting points of the elastic beam-like members 12*a* and 13*a* are positioned in the ranges of the length directions of the fixing pieces 12*c* and 13*c*, retainability of the elastic beam-like members 12*a* and 13*a* by the fixing pieces 12*c* and 13*c* is improved.

Moreover, in the present embodiment, the fixing pieces 12*c* and 13*c* provided in both of the first and second contacts 12 and 13 are fixed to the insulating housing 11 in the state that the fixing pieces are extended in an approximately horizontal direction. Therefore, supportability of the first and second contacts 12 and 13 in the inserting direction of the probe 20*a* provided in the test plug connector 20 is improved, positional accuracy at electric contact parts is improved, wobbling stability of both of the contacts 12 and 13 is improved, and positional misalignment of the first and second contacts 12 and 13 is prevented with respect to the pressing force of the test plug connector 20 and that between both of the contacts 12 and 13.

In addition, in the present embodiment, the elastic beam-like member 12*a*, which constitutes the first contact 12, is brought into contact with the elastic beam-like member 13*a*, which constitutes the second contact 13, as if scooping up the elastic beam-like member 13*a*; and, upon insertion/detachment of the test plug connector 20, the contact parts provided on both of the first and second contacts 12 and 13 are brought into contact with each other so as to be in sliding contact. Therefore, the electrical contact state thereof is maintained well, and cleanliness of the contact parts is improved by a so-called wiping action mutually between both of the contacts 12 and 13.

[About Electrically-Conductive Shell]

On the other hand, as shown in FIG. 1 to FIG. 6, an electrically-conductive shell 14 composed of a thin-plate-like electrically-conductive member is attached to the upper-surface-side surface of the above described insulating housing 11 so as to cover the insulating housing from the upper side. The electrically-conductive shell 14 is attached so as to cover part of the outer peripheral surface of the insertion guide part 11*b* from the upper surface side of the insulating housing 11, and the electrically-conductive shell 14 is formed so that an upper-surface board 14*a* covering the upper-surface-side surface of the insulating housing 11 forms an approximately rectangular shape in a plane.

At a center part of the upper surface board 14*a* forming an approximately rectangular shape in the electrically-conductive shell 14, a ground terminal part 14*b* covering the insertion guide part 11*b* of the above described insulating housing 11 from the outer side is integrally provided so as to form an approximately hollow cylindrical shape. A fixing latch groove 14*c* forming a circular shape is provided to dent the outer peripheral surface of the ground terminal part 14*b*. An engagement projection part 20*b* provided at an electrically-conductive shell of the above described test plug connector 20 is fitted in the fixing latch groove 14*c* so that the test plug connector 20 is maintained in a state that the test plug connector 20 is coupled to the switch-equipped coaxial connector 10 with appropriate mating force.

At four corner parts of the approximately rectangular shape of the upper-surface board 14*a* of the above described electrically-conductive shell 14, board connecting parts 14*d* extending so as to hang down downward are respectively provided so as to be continued therefrom. Among these four board connecting parts 14*d*, the two board connecting parts 14*d* and 14*d* adjacent to each other in the opposing direction of the first contact 12 and the second contact 13 are integrally coupled with each other. The integrally-coupled board connecting parts 14*d* and 14*d* of a first side and the board connecting parts 14*d* and 14*d* of a second side are disposed so as to sandwich the contact pair, which is composed of the first contact 12 and the second contact 13, from both sides. Solder joining pieces 14*f*, which respectively form distal end parts of the board connecting parts 14*d*, are solder-joined with a ground electrically-conductive path on an illustration-omitted wiring board, thereby establishing ground connection so as to retain the entirety of the switch-equipped coaxial connector 10.

At this point, each of the board connecting parts 14*d* thereof is extended downward from an edge of the above described upper-surface board 14*a* so as to form a curves shape, and the transverse cross-sectional shape thereof in a direction orthogonal to the direction of coupling between the two board connecting parts 14*d* and 14*d* forms a curves shape so as to form an approximately S-shape or an approximately Z-shape.

The shape of the board connecting part 14*d* provided in the electrically-conductive shell 14 will be explained in detail. The board connecting part 14*d* has an inclined wall surface having a reversed-tapered shape extended so as to be dented obliquely downward from the edge of the above described upper-surface board 14*a* toward the inner side of the connector and has a horizontal wall surface projected again approximately horizontally from a lower end part of the inclined wall surface toward the outer side of the connector. The reverse-tapered inclined wall surface and the horizontal wall surface provided at the board connecting part 14*a* define a dented part 14*e*, which is recessed toward the side of the above described second contact 13 and the first contact 12. The dented part 14*e* is configured to be provided so as to dent in the board connecting part 14*d*. Also, the horizontal wall surface of the above described board connecting part 14*a* is configured to form the solder joining piece 14*f*, which is to be solder-joined on the wiring board.

In the case in which the dented parts 14*e* are provided to be recessed in the board connecting parts 14*a* in this manner, even if an excess of a solder material or flux used for the board connecting part 14*a* of the electrically-conductive shell 14 is to move up along the board connecting parts 14*a* or other wall surfaces of the electrically-conductive shell 14, the excess of the solder or flux that is to move up there is stored in the dented part 14*e*. Moreover, the reverse-tapered inclined wall surfaces constituting the wall surfaces of the dented parts 14*e* reduce the move-up acting force of the solder material or flux. Furthermore, since the wall surface of each of the dented parts 14*e* is extended in a curved shape, the move-up length of the solder material and flux is extended, so-called solder wicking is prevented well, and influence thereof on the state of electrical conduction is significantly reduced.

Moreover, since the board connecting part 14*a* of the electrically-conductive shell 14 according to the present embodiment has the solder joining piece 14*f* extended from the dented part 14*e* toward the outer side of the connector as described above, the state of joint of the solder material with respect to the solder joining piece 14*f* of the board connecting part 14*a* is immediately checked visually by an operator, and working efficiency is improved.

In this case, a distal end part of the solder joining piece 14*f* according to the present embodiment is equal to the width-direction size of the upper-surface board 14*a*, which has the largest outer shape of the above described electrically-conductive shell 14, or positioned in a somewhat inner side of the connector. According to such a configuration, downsizing of the entirety can be carried out without causing problems in the operation of soldering with respect to the solder joining piece 14*f*.

The invention accomplished by the present inventor has been explained in detail based on the embodiment. However, the present embodiment is not limited to the above described embodiment, and it goes without saying that various modifications can be made without departing from the gist thereof.

For example, although the crank part is provided only in the first contact in the above described embodiment, the crank parts may be provided in both of the contacts, respectively.

Moreover, although the through hole is provided in the first contact in the above described embodiment, a through hole may be provided in the second contact in accordance with an overall disposing relation.

Furthermore, the present invention can be similarly applied also to a switch-equipped coaxial connector used in a use other than a circuit test switch like the above described embodiment.

As described above, the present invention can be widely applied to various switch-equipped coaxial connectors used in various electronic/electric devices.

What is claimed is:

1. A switch-equipped coaxial connector comprising a pair of contacts that extend from fixing parts fixed with an insulating housing and are disposed so as to be opposed to each other, the contacts disposed so that end parts of the pair of the contacts are in contact with each other, the switch-equipped coaxial connector configured so that a pressing force of an opposing connector inserted through an insertion hole provided in the insulating housing moves a first-side contact of the pair of the contacts in a pressing direction and separates the first-side contact from a second-side contact of the pair of the contacts;

wherein both of the pair of the contacts have respective (a) supporting boards retained in a fixed state to the fixing parts and (b) flexible elastic beam-like members that extend from the fixing parts;

the elastic beam-like member of the first-side contact of the pair of the contacts has (a) a bent part formed by bending into an approximately U-shape to extend reflected from one edge part of the supporting board in the opposite side of the second-side contact, (b) a horizontal extending part extending in a flat state from the bent part toward the second-side contact, (c) a crank part obliquely bent from one edge part of the horizontal extending part in an extending direction of the horizontal extending part toward an inserting direction of the opposing connector, and (d) a main beam part extending from the crank part to a position at which the main beam part contacts the second-side contact;

in both of the contacts, cut-away parts that substantially increase span lengths of the elastic beam-like members are respectively formed at boundary parts between the fixing parts and the elastic beam-like members; and gaps that ensure flexibility of the elastic beam-like members are provided between the contacts and the insulating housing.

2. The switch-equipped coaxial connector according to claim 1, wherein the fixing parts fixed with the insulating housing are disposed at respective ones of the supporting boards, configured to be extended in directions in which the pair of contacts are opposed to each other, and engaged with the insulating housing.

3. The switch-equipped coaxial connector according to claim 1, wherein one of the cut-away parts is formed so as to form a groove shape at a coupling part between one of the fixing parts and the corresponding one of the elastic beam-like members.

4. The switch-equipped coaxial connector according to claim 1, wherein the crank part is configured so as to be obliquely bent and extended from an intermediate position in an extending direction of the elastic beam-like member toward the inserting direction of the opposing connector and then obliquely bent toward a direction opposite to the inserting direction of the opposing connector; and a distal end part of the elastic beam-like member extended from the crank part is disposed so as to be brought into contact with the second-side contact from the direction opposite to the inserting direction of the opposing connector.

5. The switch-equipped coaxial connector according to claim 1, wherein, in the elastic beam-like member of the first-side contact, a through hole is formed at a part to be brought into contact with the opposing connector.

* * * * *